United States Patent [19]

Hartford et al.

[11] Patent Number: 4,906,119

[45] Date of Patent: Mar. 6, 1990

[54] HANDWRITING STABILIZER

[76] Inventors: Lloyd Hartford, 18243 San Fernando Mission Blvd., Northridge, Calif. 91326; Albert O. Cota, 17475 Flanders St., Granada Hills, Calif. 91344

[21] Appl. No.: 220,527

[22] Filed: Jul. 13, 1988

Related U.S. Application Data

[63] Continuation-in-part of Ser. No. 181,589, Apr. 14, 1988, abandoned.

[51] Int. Cl.[4] ..... B43K 7/00; B43K 7/12; B43K 24/00

[52] U.S. Cl. ..... 401/6; 401/48; 401/99

[58] Field of Search ..... 401/6–8, 401/48, 91, 99, 115, 117, 209, 210; 15/435–437, 439, 443–445; D19/41, 45, 46, 47–50, 54, 55

[56] References Cited

U.S. PATENT DOCUMENTS

| | | | |
|---|---|---|---|
| D 252,757 | 8/1979 | Sublette | 401/6 X |
| 317,309 | 5/1885 | Cox | 401/6 X |
| 433,303 | 7/1890 | Palmer | 15/443 |
| 2,497,418 | 2/1950 | Schroeder, Jr. | 15/437 X |
| 2,870,742 | 1/1959 | Hackmyer | 401/209 X |
| 2,911,950 | 11/1959 | Freeman | 401/209 |
| 3,338,217 | 8/1967 | Harrison | 401/6 X |
| 3,994,605 | 11/1976 | McKnight | 401/99 |
| 4,095,906 | 6/1978 | Sackett | 401/48 |
| 4,269,529 | 5/1981 | McCollough | 401/6 X |
| 4,306,819 | 12/1981 | Schüsseler | 401/209 X |
| 4,511,272 | 4/1985 | Brown et al. | 401/48 X |
| 4,580,919 | 4/1986 | Ambrasz | 401/117 |

FOREIGN PATENT DOCUMENTS

| | | | |
|---|---|---|---|
| 1253384 | 1/1961 | France | 401/6 |
| 16586 | 4/1898 | Switzerland | 15/437 |

*Primary Examiner*—Richard J. Apley
*Assistant Examiner*—David J. Bender
*Attorney, Agent, or Firm*—Albert O. Cota

[57] ABSTRACT

A handwriting stabilizer (10) that when held in a trembling head, the hand steadies to allow smooth writing or printing. The stabilizer (10) includes a body having an outwardly extending stabilizing section (14) formed separately from a forwardly located curved gripping section (18) having a bottom surface (20) that is parallel to the writing surface. The gripping and stabilizing sections have a curved ink cartridge bore (32) that extends from the bottom surface (20) of the gripping section, curves upwardly and continues through the stabilizing section (14). Through this bore is inserted a curved ink cartridge (34) having a writing point (28). When in the writing mode, the stabilizing section is pushed forwardly allowing the writing point (28) to project through the bore (32) in the gripping section. Conversely, when the stabilizing section (14) is pulled outwardly, the writing point (28) retracts into the bore (32). The interface of the stabilizer section (14) and the gripping section (18) forms an articulated joint that allows the stabilizer (10) to automatically adjust to either a right or left hand and ergonomically conforms to any holding angle required by the hand.

7 Claims, 5 Drawing Sheets

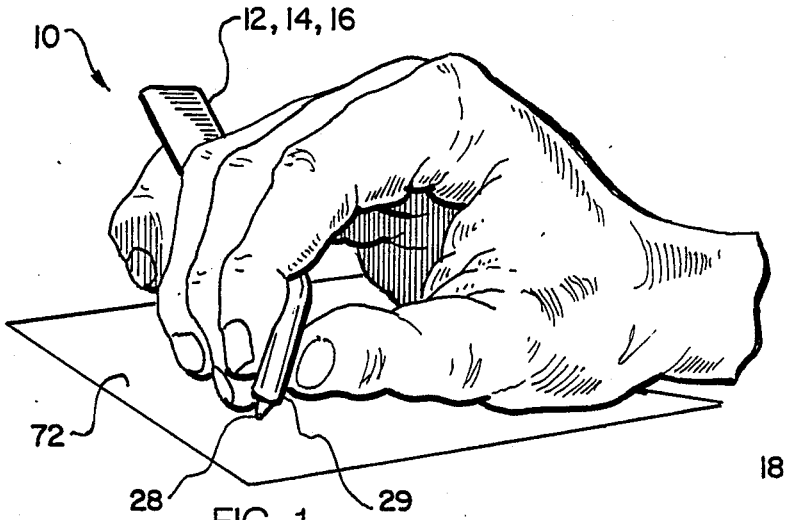
FIG. 1
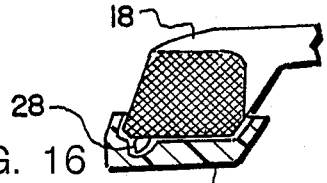
FIG. 16
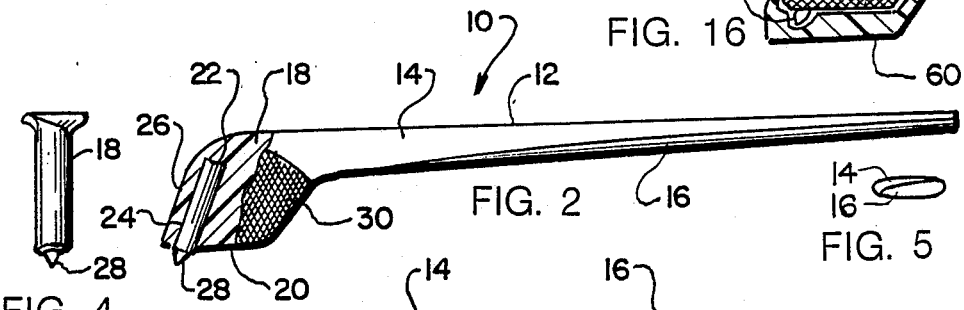
FIG. 2
FIG. 4
FIG. 5
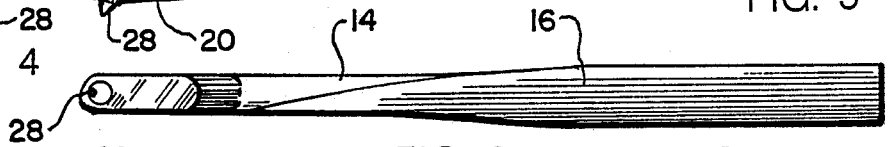
FIG. 3
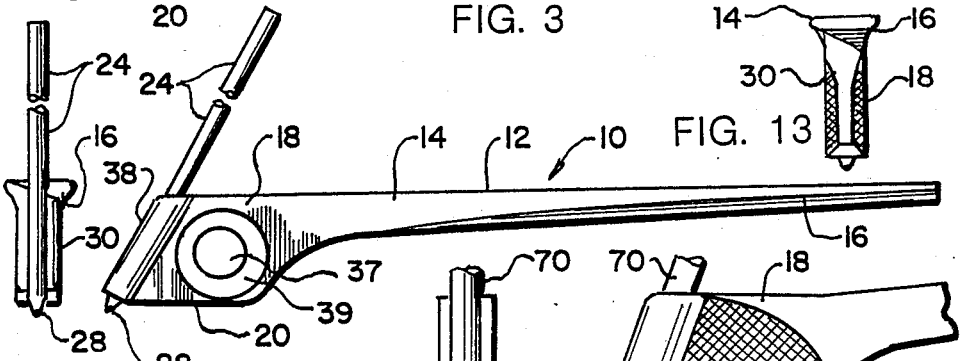
FIG. 12
FIG. 11
FIG. 13
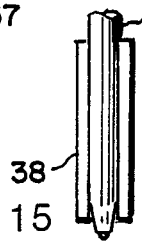
FIG. 15
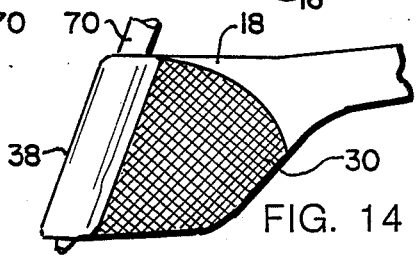
FIG. 14

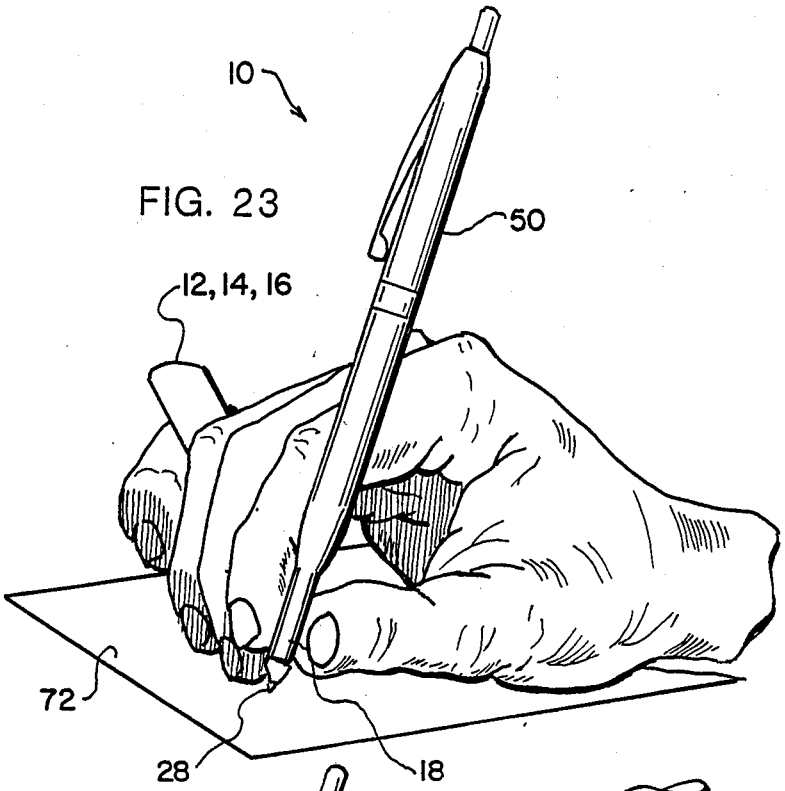
FIG. 23
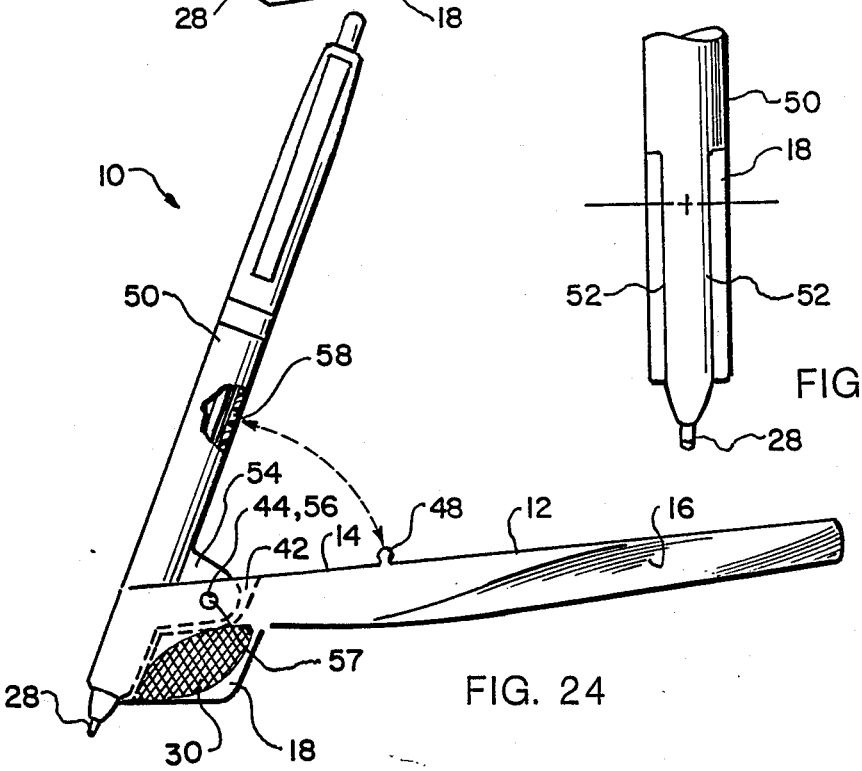
FIG. 24
FIG. 25

HANDWRITING STABILIZER

CROSS REFERENCE TO RELATED APPLICATION

This application is a continuation-in-part of application Ser. No. 07/181,589 filed Apr. 14, 1988 now abandoned.

BACKGROUND ART

It is estimated that worldwide there are several million persons that are afflicted with disabling ailments such as Alzheimers and Parkinson disease and other disabling impairments resulting from neurological dysfunctions due to damage of the contra-lateral motor strip, strokes and the like. In many cases, these ailments caused the hand and/or the arm to pulse and tremble at a rate that makes writing and printing very difficult to perform.

Many attempts have been made in the past to provide invasive and non-invasive devices that would steady the hand sufficiently to allow writing and printing to be facilitated. The prior art has disclosed various designs of these non-invasive devices that allow the hand of a normal, non-afflicted person to be steadied. These devices, however, are either to bulky, lack portability and most importantly, do not provide the degree of control required to allow a trembling hand to be steadied sufficiently to allow for smooth writing. The ability to be able to once again write easily and legibly certainly adds to the selfworth and esteem of mentally and physically challenged persons.

A search of the prior art did not disclose any patents that read directly on the claims of the instant invention however, the following U.S. patents were considered related:

| U.S. Pat. No. | INVENTOR | ISSUED |
|---|---|---|
| 1,669,755 | Hopper | 15 May 1928 |
| 1,184,155 | Williams | 27 May 1916 |
| 578,773 | Rhone | 16 Mar 1897 |
| 485,440 | Thornhill | 1 Nov 1892 |

The Hopper patent discloses a combined guard and corrective appliance for writing instruments The appliance consists of a pen or pencil that is slipped into a sleeve clip that includes a lug with an eyelet. Movably attached to the eyelet is an arm that extends outwardly from the pen. To use the appliance, the pen is normally held and the outwardly extending arm is grasped by the remaining finger. The pen is then placed upon the surface of the writing paper and the end of the arm is allowed to rest and glide on the paper. The arm as it glides over the paper, along with the pen, affords support to the hand to thus, steady the hand during the writing operation.

The Williams patent discloses a device designed to teach penmanship. The device consists of an elongated body having a bore on one end and a ball shaped section on the opposite end. To use the device, the hole is placed over a pen or pencil and then the body is clasped in the hand with the pen situated in the correct writing position. The ball is allowed to rest on the paper so that when writing, the hand is resting on the tips of the nails of the third and fourth fingers rather than upon the fleshy part of the hand.

The Rhone patent discloses a pen holder designed to relieve writing cramps and to rest the hand by allowing the position of the holder in the hand to be changed. The device consists of a handle with a sleeve attached to its forward end. Within the sleeve is pivotally attached a cylinder socket/holder that holds a pen point. To use the device, the cylinder socket/holder is pivoted outwardly and the pen is normally held. The handle and sleeve, which are normal to the cylinder socket/holder, is grasped within the hand with the handle and sleeve projecting from the respective sides of the hand. The device may be used as an ordinary pen holder and when the hand becomes cramped the socket/holder may be turned outwardly and held as described.

The Thornhill patent discloses a carrier that guides a pen or pencil when writing. The carrier is made of wire in the form of a V-shaped loop with the arms of the loop having at their extremities eyes for receiving and holding the pen or pencil in place. One of the arms is provided with an eye for receiving the fourth finger and a loop for receiving the first finger. To use the carrier, the pen or pencil is inserted into the eyes and the fourth and first fingers are inserted into their respective eye and loop. The carrier is then guided along the writing surface.

DISCLOSURE OF THE INVENTION

A handwriting stabilizer that when held in a trembling hand, the hand steadies sufficiently to allow a person to write and/or print with steady strokes. The stabilizer, in the preferred embodiment, consists of a body having two separate sections: an outwardly extending stabilizing section and a curved gripping section in alignment with the front of the stabilizing section. The curved gripping section and the stabilizing section are designed to hold a curved ink cartridge that is applied through an ink cartridge bore that extends from the bottom surface of the gripping section and into the stabilizing section.

The interface between the two sections forms an articulated joint that allows the stabilizing section to rotate about the gripping section to thus automatically adjust the stabilizer to fit either a right or left hand and to conform to any angle(s) to ergonomically fit the hand. The two-piece stabilizer is also mechanized to allow the writing pint of the curved ink cartridge to be extended or retracted. When extended the stabilizing section is pushed forwardly; conversely, to retract the point, the stabilizing section is displaced outwardly.

The curved gripping section may also be designed to include a glide bump that is located on its bottom surface on the same plane as the tip of the writing point. The glide bump facilities writing by keeping the writing point at a correct writing angle and allows the stabilizer to smoothly traverse the writing surface during use.

The stabilizer is used by preferably grasping the stabilizing section with its end projecting outwardly between the ring finger and the little finger. The gripping section is then held between the forefinger and the thumb. To commence writing or printing, the fingers around the gripping section are positioned so that when the pen point is on the writing surface, these fingers as well as the hand are resting on the writing surface.

In view of the above description, it is the primary object of the invention to provide a handwriting stabilizer that is easily manipulated by physically and mentally challenged persons with a writing or printing impairment to sufficiently overcome their handicap and write plainly.

It is also an object of the invention to provide a stabilizer that can be adjusted to fit the particular shape of the hand and fingers of any individual.

An additional object is to have a stabilizer that can be easily and cost-effectively produced.

In addition to the above objects, it is also an object to have a stabilizer that:

is as reliable as a conventional ballpoint pen, can be made of any material that is sufficiently rigid to support the pen point including personalized stabilizers made of exotic wood grains and precious metals, can be made to accommodate a wide range of pen points from the very fine to the widest as used in calligraphy, can be made to accommodate the right hand or the left hand, reduces writing fatigue after the writer becomes accustomed to comfortably holding and using the stabilizer, promotes the use of the Palmer method for writing since the arm rather than the fingers are used to form the cursive characters, and can be used by anyone who writes excessively to reduce cramps and fatigue.

BRIEF DESCRIPTION OF THE DRAWINGS

FIG. 1 is a perspective view of the non-retractable handwriting stabilizer being held in its writing position.

FIG. 2 is a partial cross-sectional, side view of a non-retractable stabilizer having a straight ink cartridge within its gripping section.

FIG. 3 is a bottom view of the stabilizer illustrated in FIG. 2.

FIG. 4 is a front view of the stabilizer illustrated in FIG. 2.

FIG. 5 is a back view of the stabilizer illustrated in FIG. 2 showing a tilted stabilizing section.

FIG. 11 is a side view of a stabilizer that has a gripping section with a clip attached that holds a straight ink cartridge.

FIG. 12 is a front view of the stabilizer illustrated in FIG. 11.

FIG. 13 is a rear view of the stabilizer showing a gripping section with a curved finger grip.

FIG. 14 is a partial side view of a stabilizer similar to that illustrated in FIG. 11 but having a clip large enough to hold a ballpoint pen.

FIG. 15 is a front view of the stabilizer illustrated in FIG. 14.

FIG. 16 is a side cross-sectional view of a typical cap that fits over the bottom of the gripping section.

FIG. 23 is a perspective view of the retractable handwriting stabilizer being held in its writing position.

FIG. 24 is a side view of the retractable stabilizer shown in its fully extended writing position.

FIG. 25 is a partial front view of the retractable stabilizer shown in its fully extended writing position.

BEST MODE FOR CARRYING OUT THE INVENTION

Figures 6, 7, 8, 9, 10:
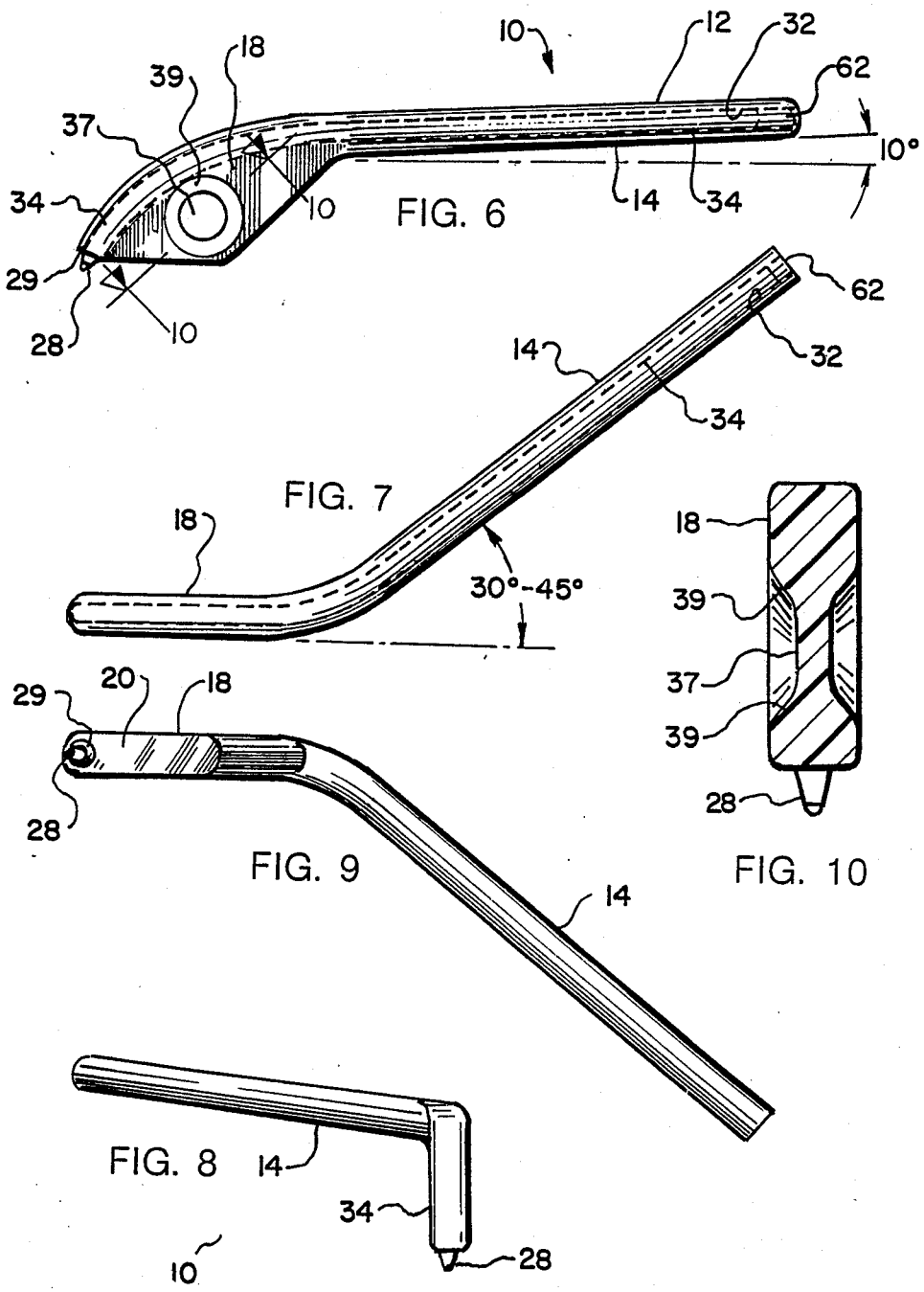
FIG. 6 is a cross-sectional side view of the ergonomically designed non-retractable stabilizer having a curved ink cartridge within the gripping section and the stabilizing section.
FIG. 7 is a cross-sectional top view of the stabilizer illustrated in FIG. 6.
FIG. 8 is a front view of the stabilizer illustrated in FIG. 6.
FIG. 9 is a bottom view of the stabilizer illustrated in FIG. 6.
FIG. 10 is a cross-sectional view of the finger gripping bore and curved perimeter as taken along lines 10—10 of FIG. 6.

The best mode for carrying out the handwriting stabilizer is presented in two embodiments. The preferred embodiment is disclosed in two designs configurations: the first design is an integral handwriting stabilizer and the second design covers a retractable handwriting stabilizer that is made in two separate parts. The second embodiment covers a handwriting stabilizer that requires the use of a specially designed retractable ballpoint pen assembly. In either embodiment, the handwriting stabilizer is designed to stabilize the hand while in the process of cursive writing or printing.

The first design of the handwriting stabilizer 10 preferred embodiment, as shown in FIGS. 1–16 is comprised of a body 12 that incorporates an integral stabilizing section 14 that extends longitudinally and a forwardly located gripping section 18. The gripping section curves downwardly, with respect to the stabilizing section, and terminates in a flat surface 20 that is parallel to a writing surface 72. The gripping section also includes a means for attaching a writing instrument such as a straight or curved ink cartridge 24 or 34 respectively or a ballpoint pen 70.

Figure 22:
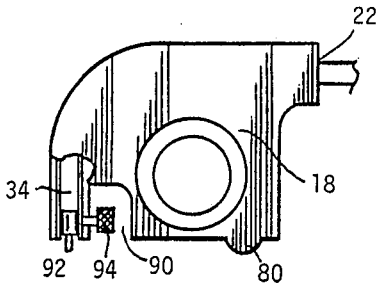
FIG. 22 is a side view of the gripping section showing a method by which the writing point can be locked when in the writing position.

In all cases, as shown in FIG. 1, the body 12 is grasped by the hand with the stabilizing section 14 extended across the hand with the end of the stabilizing section projecting between the ring and little fingers and with the tips of the index finger and thumb holding the gripping section 18. All of the stabilizer 10 designs may be made with a stabilizing section 14 having round cross-section as shown in FIG. 22, or with an eliptical cross-section that has a slightly tilted section 16 as shown in FIGS. 3 and 5. The tilted section allows the stabilizing section to fit more comfortably when held in the hand in its writing position as shown in FIG. 1.

Additionally, the stabilizer 10 may also be designed with a stabilizing section 14 that tilts upwardly approximately 10-degrees from its interfacing point with the gripping section 18 as shown in FIG. 6; and/or that is angled outwardly between 30 to 45-degrees from the same interfacing point and with respect to the side plane of the gripping section 18 as shown in FIG. 7. Note that the upward and outward tilt angles correspond closely to the angles of the hand when the hand is in its normal writing position. Thus, a stabilizer 10 constructed with these two angles is ergonomically correct.

The body 12 may be of any material such as various compounds of plastic, metal or wood, with plastic preferred. If a plastic is used and the tilt angle(s) are not precasted, they may be easily formed to an angle that best fits the users hand by holding the body 12 over a heat source, such as an oven grille. When the plastic is heated, it can be easily bent to the desired shape.

The simplest of the non-retractable stabilizer designs is shown in FIGS. 1–5. In this design, the stabilizing section 14 incorporates a tilted section 16 and the gripping section 18 include a straight ink cartridge bore 22 that extends upwardly from the flat surface 20 of the gripping section. The bore 22 extends in a straight vertical path that is parallel and near the front surface 26 of the gripping section 18. The bore 22 is sized to allow a writing instrument such as a short straight ink cartridge 24, as shown in FIGS. 2, 3 and 4, to be inserted to a depth that allows the writing point 28 of the cartridge 24 to extend a short distance from the flat surface 20 of the gripping section 18.

In all of the designs disclosed, the gripping section may include a finger grip surface 30 on each of its sides that extends downwardly to the flat surface 20 as best shown in FIGS. 2 and 14. The finger grip surface may also be extended downwardly in a curve toward the flat surface of the gripping section as shown in FIG. 13. When so curved, writing control is further enhanced. Alternatively, the gripping section 18 may be made with sides having therethrough a finger gripping bore 37 as shown in FIGS. 6 and 11. The comfort and guiding control provided by this bore may be further enhanced by having curved perimeter sides 39 that curve inwardly as shown best in FIG. 10. As with all designs, the gripping surface 30 or gripping bore 37 is held between the index finger and thumb of the hand.

The second method for attaching the writing instrument to the body 12 is shown in FIGS. 6–9. In this design, in lieu of the straight ink cartridge bore 22, a curved ink cartridge bore 32 is employed.

This bore commences a short distance above the flat surface 20 of the gripping section 18 and continues upwardly following the upper contours of the gripping section 18 and the stabilizing section 14. In this design, the bottom surface of the gripping section has a writing point bore 29 that is concentrically aligned and interfaces with the ink point 28 of the curved ink cartridge bore 32. The bore 32 is sized to allow the curved ink cartridge 34 to be initially inserted through the end of the stabilizing section 14. After the cartridge is inserted, a plug 62 is inserted into the curved ink cartridge bore 32 to prevent ink leakage.

A standard 5-inch (12.7 cm) thermoplastic ink cartridge may be used for the curved ink cartridge 34. These standard cartridges have the resiliency to allow them to be easily inserted into and curved around the curved ink cartridge bore 32.

The cartridge 34 is pushed through until the cartridge writing point 28 projects through the writing point bore 29. When properly seated, the writing point projects a short distance from the flat surface 20 of the gripping section 18 at an angle that allows the writing point to be easily viewed during the writing process. By allowing the point to be viewed, the user's confidence is increased which further aides in controlling the speed and quality of the writing.

In lieu of the curved ink cartridge bore 32, the gripping section 18 and the stabilizing section 14 may be made with an outer surface having an ink cartridge channel 36. The channel commences a short distance above the flat surface 20 of the gripping section and terminates a short distance from the end of the stabilizing section. The channel is also sized to allow the writing point 28 of the curved ink cartridge 34 to be inserted through the writing point bore 29 so that the point extends a short distance from the flat surface 20 of the gripping section 18 at a proper angle. The remainder of the curved ink cartridge is held within the channel 36.

In this second writing instrument attaching scheme, the body 12 may be made in two halves with the curved ink cartridge bore 32 or ink cartridge channel 36 cast on each half of the body. The curved ink cartridge is then laid on one half of the body and the second half is attached to complete the stabilizer 10. Alternatively, the writing stabilizer body 12 may be cast around a curved metal tube that is sized to receive the curved ink cartridge 34.

The third and final instrument attaching scheme for the non-retractable stabilizer 10 is shown in FIGS. 11–15. This method eliminates the ink cartridge bore and instead incorporates a clip 38. The clip is attached longitudinally to the front surface 26 of the gripping section 18 by an attaching means which includes an adhesive, rivets or the like. Two sizes of clips 38 are disclosed: the first size, as shown in FIGS. 11 and 12, is sized to firmly hold a ballpoint straight ink cartridge 24, the second size, as shown in FIGS. 14 and 15, is sized to firmly hold a standard ballpoint pen 70. This design allows the flexibility of having a stabilizer 10 that can have interchangeable ink cartridges or pens of different colors and ink point diameters. Additionally, in any of the non-retractable designs, a cap 60 can be placed over the flat surface 20 of the gripping section 18 and the writing point to prevent the pen from drying or marking when not in use. A typical cap 60 is shown in FIG. 16.

The second design of the handwriting stabilizer 10 preferred embodiment, as shown in FIGS. 17–22, is similar in form and function with the exception that the stabilizing section 14 is formed separately from the gripping section 18.

The gripping section, as with the first design, curves downwardly with respect to the stabilizing section, has a flat bottom surface 20 that is substantially parallel to the writing surface and a flat back surface 21 that is normal to the bottom surface 20. The gripping section also has a curved ink cartridge bore 32, a shown in FIG. 17, that commences a short distance above the flat bottom surface 20 near its front surface 26. The bore continues upwardly following the contour of the gripping section and terminates through the flat back section 21. The flat bottom surface 20 also includes a writing point bore 29 that is concentrically aligned and interfaces with the bore 32. The curved ink cartridge bore 32 is sized to allow the curved ink cartridge 34 to be slideably inserted with the writing point 28 projecting through the writing point bore 29 a short distance from the flat bottom surface of the gripping section. The remainder of the ink cartridge projects through the gripping section's flat back section 21.

Figure 17:
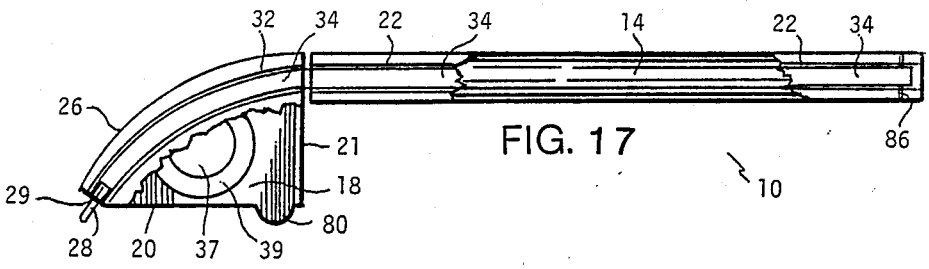
FIG. 17 is a partial sectional side view of the retractable stabilizer of the preferred embodiment shown in the extended writing position.

The flat bottom surface 20 is designed to have a glide bump 80 as shown in FIG. 17. The glide bump extends downwardly from the flat bottom surface 20 of the gripping section 18 near the edge opposite the location of the writing point 28 with the end of the bump 80 located on the same plane as the tip of the writing point 28.

Figure 18:
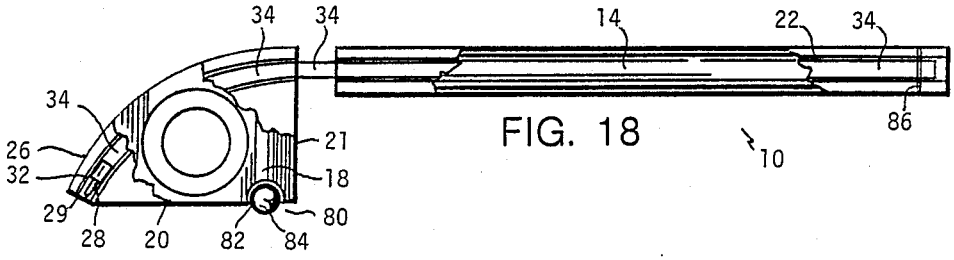
FIG. 18 is a partial sectional side view of the retractable stabilizer of the preferred embodiment shown in the retracted, non-writing position.
Figure 19:
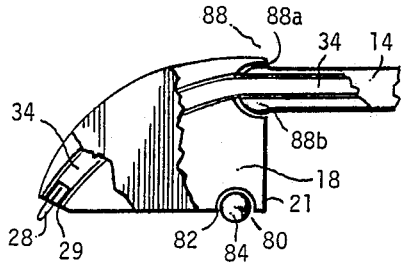
FIG. 19 is a partial sectional side view of the retractable stabilizer with a socket-and-ball joint connecting the gripping section and the stabilizing section in the extended writing position.
Figure 20:
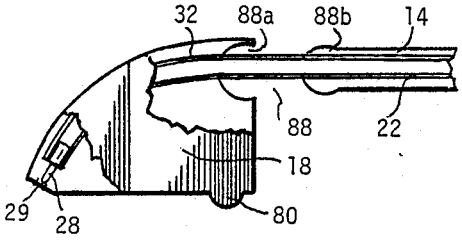
FIG. 20 is a partial sectional side view of the retractable stabilizer having the socket-and-ball joint separated to maintain the stabilizer in the retracted position.

The glide bump 80 may be made as an integral extension of the gripping section 18 as shown in FIGS. 17 and 20 or, as shown in FIGS. 18 and 19, the gripping section may be designed with a ball bearing socket 82 into which is captively and rotatably held a ball bearing 84. In either case, the glide bump serves to keep the writing point 28 at a proper writing angle and allows the handwriting stabilizer 10 to smoothly traverse the writing surface when being used.

The separate stabilizing section 14 of the embodiment has, as shown in FIGS. 17 and 18, a straight ink cartridge bore 22 that extends therethrough. The bore is sized to slideably receive the remaining section of the curved ink cartridge 34 projecting through the flat back section 21 of the gripping section 18. The stabilizing section 14 has a longitudinal length that allows the ink cartridge 34 to terminate near the outward end of the stabilizing section. The outward end of the ink cartridge is locked to the stabilizing section by a locking means such as a cartridge retaining pin 86 as shown in FIGS. 17 and 18. Thus, when the stabilizing section is pushed forwardly, as shown in FIG. 17, the writing point 28 extends through the writing point bore 29. Conversely, when the stabilizing section 14 is displaced in an outwardly direction, as shown in FIG. 18, the writing point 28 is caused to retract into the writing point bore 29 and curved ink cartridge bore 32. Preferably, the writing point retraction is accomplished by pressing the writing point against a hard surface allowing the point to be pushed into the bores 29,32. The retraction feature allows the handwriting stabilizer to be placed in a shirt pocket or purse without fearing that the writing point will mark the pocket or purse.

Figure 21:
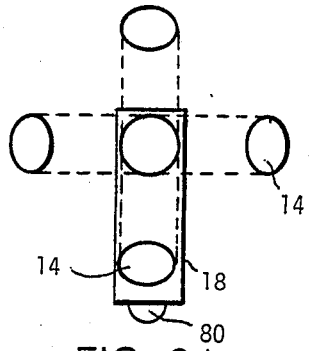
FIG. 21 is a back view of the retractable stabilizer showing how the stabilizing section can be made to rotate 360-degrees about the gripping section.
Figure 26:
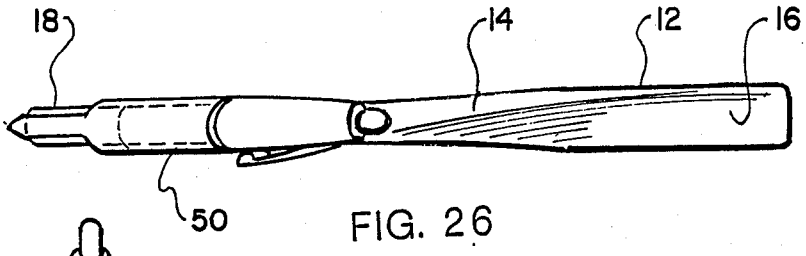
FIG. 26 is a top view of the retractable stabilizer shown in its fully extended writing position.
Figure 27:
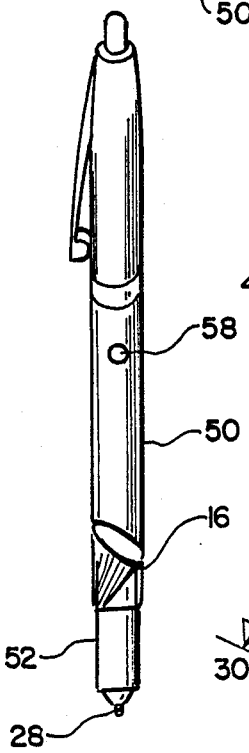
FIG. 27 is a rear view of the retractable stabilizer shown in its fully extended writing position and illustrating a typical tilted section.
Figure 28:
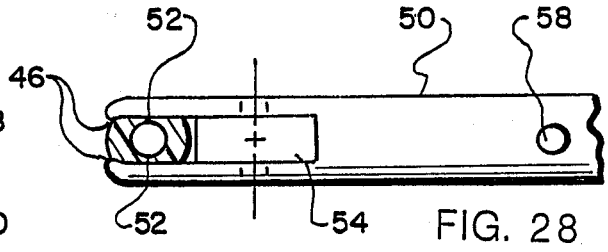
FIG. 28 is a partial top view of the retractable stabilizer showing the flat sides of the ballpoint pen held in place within the inverted L-channel.
Figure 29:
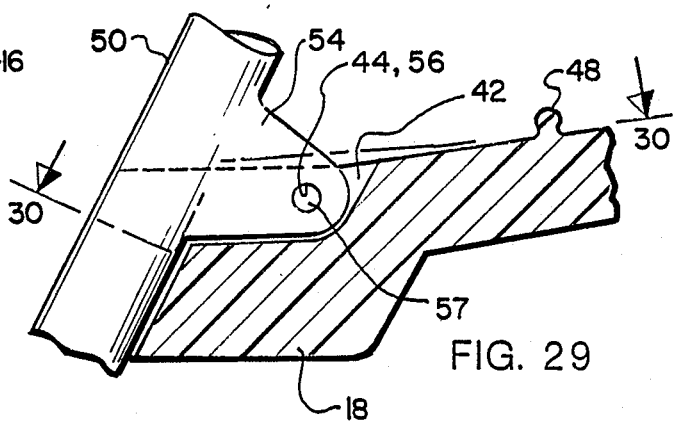
FIG. 29 is a partial cut-away side view of the retractable stabilizer detailing how the ballpoint pen fits into the inverted L-channel.
Figure 30:
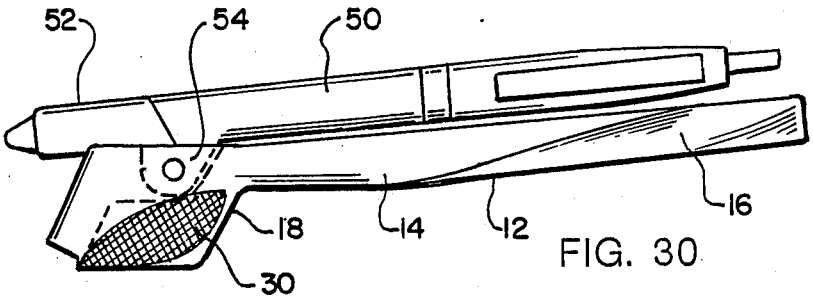
FIG. 30 is a side view of the retractable stabilizer shown in its fully retracted non-writing position.

The two-part stabilizer 10 is held together by means of the curved ink cartridge 34, as shown in FIGS. 17 and 18. The joint formed at the interface of the gripping section 18 and stabilizing section 14 forms a 360-degree articulated joint as depicted in FIG. 21. Thus, the stabilizer 10 automatically adjusts to an ergonomic shape that will conform to either a right or left hand and any angular displacement required by the hand to comfortably hold and operate the stabilizer 10.

An alternative articulated joint is shown in FIGS. 19 and 20. In this scheme, a ball-and-socket joint 88 is employed that allows the stabilizing section 14 to rotate about the gripping section 18. The socket 88*a* is located on the flat back section 21 of the gripping section 18 and is in concentric alignment with the curved ink cartridge bore 32. The ball 88*b* is located at the forward end of the stabilizing section 14 in concentric alignment with the straight ink cartridge bore 22. The ball 88*b* is sized to easily enter and be held detachably captive within the socket 88*a* as shown in FIG. 19. Like the previously described articulated joint, the joint 88 also produces an ergonomic fit and allows the writing point to be extended or retracted.

An additional implement that may be included in the design of the stabilizer 10 is a means to secure the writing point 28 of the curved ink cartridge 34 when the point is in the fully extended, writing position. One such means as shown in FIG. 22 includes a notch 90 having a front surface near and parallel to the back wall of the curved ink cartridge bore 32. The front surface of the notch 90 has a threaded bore 92 that extends through the back wall of the curved ink cartridge bore. Into the threaded bore 92 is threaded a writing-point holding screw 94. When this screw is rotated it tightens and further retains the writing point in its extended, writing position.

The second embodiment of the writing stabilizer 10 is shown in FIGS. 23–30. This design also includes a body 12 having an integral stabilizing section 14 that extends outwardly and a forwardly located gripping section 18. The gripping section, as shown best in FIGS. 18, 22 and 23, has an inverted L-channel 42 having a first pivot bore 44 therethrough as shown in FIG. 18 and a set of lock bumps 46 as shown in FIG. 22. The body 12 also includes a male detent 48, as shown in FIG. 18, that extends from the upper surface of the stabilizing section 14.

To utilize the retractable handwriting stabilizer 10, a special ballpoint pen assembly 50 is required. This pen, has a forward end that has flat sides 52 as best shown in FIGS. 19 and 22. The width of the flat end is sized to slidably fit and lock itself into the inverted L-channel 42 when the pen 50 is in its writing position as shown in FIG. 18. On the bottom of the pen 50, in line with the flat end, is located a trunnion 54. The trunnion has a second pivot bore 56 therethrough and is also sized to swivelly fit into the inverted L-channel 42 with the first pivot bore 44 in alignment with the second pivot bore 56. The trunnion is pivotally held within the L-channel by inserting a pivot pin 57 through the two bores 44, 56.

The ballpoint pen includes a female detent 58 that is located and positioned on the bottom of said pen as shown in FIGS. 18 and 22. When the pen is pivoted clockwise, the female detent 58 is inserted into the male detent 48, located on the body 12, to hold the pen on the upper surface of the body in its retracted non-writing configuration.

The retractable handwriting stabilizer incorporates all of the features of the non-retractable designs and adds the utility of having a single device that can be retracted for carrying and storage and that can be easily extended for use when required.

OPERATING INSTRUCTIONS

1. To hold and manipulate the handwriting stabilizer, the following finger placements are maintained:
   - 1.1 The thumb and index finger are used to grip the finger grip surface 30 of the gripping section 18 just behind the pen writing point 28.
   - 1.2 The middle and ring fingers are placed over and around the top of the stabilizing section 14.
   - 1.3 The little finger is placed under the stabilizing section 14. That is, the stabilizing section is partially held between the lower part of the ring finger and upper part of the little finger. The little finger plays an important part in that it locks the stabilizer in place within the hand and aids in controlling the pen point pressure.

2. When writing, keep the hand down with the side of the thumb and tip of the index finger resting on the writing surface 72.

3. When first beginning to use the stabilizer 10, write slowly otherwise, the body's nervous system will override the supporting features of this writing technique—writing speed will increase with practice.

4. As you write, maintain a constant and comfortable gripping pressure on the stabilizer 10.

5. Keep the pen writing point 28 in your line of sight as you write. By viewing the writing flow, confidence is increased.

While the invention has been described in complete detail and pictorially shown in the accompanying drawings, it is not to be limited to such details, since many changes and modifications may be made to the invention without departing from the spirit and the scope thereof. For example, the stabilizer, without departing from its basic design, can be modified to allow its use by persons having injured hands or finger loss. Additionally, the stabilizer's basic outline shape can be changed without affecting its function. Hence, it is described to cover any and all modifications and forms which may come within the language and scope of the claims.

We claim:

1. A handwriting stabilizer comprising:

(a) a curved ink cartridge having a writing point, (b) a body consisting of a stabilizing section that extends longitudinally and a separately formed forwardly located gripping section that curves downwardly with respect to the stabilizing section, has a flat bottom surface that is substantially parallel to a writing surface and a flat back surface, (c) a curved ink cartridge bore that commences a short distance above the flat bottom surface of said gripping section, near its front surface, and continues upwardly following the contour of said gripping section and terminating through the flat back surface, and with the bottom surface of said gripping section also having a writing point bore that is concentrically aligned and interfaces with said curved ink cartridge bore, where said curved ink cartridge bore is sized to allow said curved ink cartridge to be slideably inserted with the writing point projecting through said writing point bore a short distance from the flat bottom surface of said gripping section and with the remainder of said ink cartridge projecting through the flat back surface of said gripping section, (d) said stabilizing section having a straight ink cartridge bore extending therethrough that is sized to slideably receive the remaining section of said curved ink cartridge projecting through the flat back surface of said gripping section where said stabilizing section has a longitudinal length that allows said ink cartridge to terminate near the outward end of said stabilizing section and, (e) a means to lock the outward end of said ink cartridge to the stabilizing section such that when said stabilizing section is pulled away from said gripping section, the writing point retracts into said curved ink cartridge and conversely, when said stabilizing section is pushed forwardly, the writing point projects through said writing point bore.

2. The stabilizer as specified in claim 1, further comprising:

a glide bump extending downwardly from the flat bottom surface of said gripping section and located near the edge opposite the location of the writing point, wherein the end of said bump is on the same plane as the tip of said writing point.

3. The stabilizer as specified in claim 2 wherein said glide bump is an integral extension of said gripping section.

4. The stabilizer as specified in claim 2 wherein said glide bump further comprises:

(a) a gripping section having a ball bearing socket, and (b) a ball bearing captively and rotatably held within said ball bearing socket.

5. The stabilizer as specified in claim 2 further comprising a ball-and-socket joint that allows said stabilizing section to rotate about said gripping section where:

(a) said socket is located on the flat back section of said gripping section in concentric alignment with said curved ink cartridge bore, and (b) said ball is located at the forward end of said stabilizing section in concentric alignment with said straight ink cartridge bore, where said ball is sized to easily enter and be held detachably captive within said socket.

6. The stabilizer as specified in claim 2 further comprising a means to secure the writing point of said curved ink cartridge to said ink cartridge bore when the writing point is in its fully extended writing position.

7. A handwriting stabilizer comprising:

(a) a curved ink cartridge having a writing point, (b) a body consisting of a stabilizing section that extends longitudinally and a forwardly located gripping section that curves downwardly with respect to the stabilizing section and terminates in a flat bottom surface that is substantially parallel to a writing surface, and a flat back surface that is normal to the flat bottom surface with said gripping section further having:

(1) a curved ink cartridge bore that commences a short distance above the flat bottom surface of said gripping section, near its front surface, and continues upwardly following the contour of said gripping section and terminating through the flat back surface, and with the bottom surface of said gripping section also having a writing point bore that is concentrically aligned and interfaces with said curved ink cartridge bore, where said curved ink cartridge bore is sized to allow said curved ink cartridge to be slideably inserted with the writing point projecting through said writing point bore a short distance from the flat bottom surface of said gripping section and with the remainder of said ink cartridge projecting through the flat back surface of said gripping section, (2) a glide bump extending downwardly from the flat bottom surface of said gripping section and located near the edge opposite the location of the writing point where end of said bump is on the same plane as the tip of said writing point, (c) said stabilizing section having a straight ink cartridge bore extending therethrough that is sized to slideably receive the remaining section of said curved ink cartridge projecting through the flat back surface of said gripping section where said stabilizing section has a longitudinal length that allows said ink cartridge to terminate near the outward end of said stabilizing section, (d) a means to lock the outward end of said ink cartridge to the stabilizing section such that when said stabilizing section is pulled away from said gripping section, the ink point retracts into said curved ink cartridge bore, (e) a means to secure the writing point of said curved ink cartridge to said ink cartridge bore when the writing point is in its fully extended writing position, (f) said gripping section having:

(1) a notch with a front surface near and parallel to the back wall of said curved ink cartridge bore with said front surface having a threaded bore that extends through the back wall of said curved ink cartridge bore, (2) said means to secure the writing point further comprises a threaded writing-point holding screw sized to be threaded into said threaded bore such that when rotated said screw tightens and holds in place said writing point in its extended position.

* * * * *